United States Patent [19]

Mitter

[11] 4,131,000

[45] Dec. 26, 1978

[54] PATTERN PRINTING APPARATUS

[76] Inventor: Mathias Mitter, Falkenstrabe 57, 4815 Schloss Holte, Fed. Rep. of Germany

[21] Appl. No.: 830,443

[22] Filed: Sep. 6, 1977

Related U.S. Application Data

[63] Continuation-in-part of Ser. No. 735,198, Oct. 26, 1976.

[30] Foreign Application Priority Data

Sep. 7, 1976 [DE] Fed. Rep. of Germany ..... 2640131

[51] Int. Cl.[2] ..... D06B 1/08; D06B 11/00

[52] U.S. Cl. ..... 68/200; 101/26; 118/211; 118/243

[58] Field of Search ..... 68/200, 201, 205 R; 118/211, 243, 263, 37; 101/26

[56] References Cited

U.S. PATENT DOCUMENTS

| | | | |
|---|---|---|---|
| 636,115 | 10/1899 | Cameron | 101/26 |
| 681,121 | 8/1901 | Hudson | 101/26 |
| 1,915,779 | 6/1933 | Gere | 68/205 R |

*Primary Examiner*—Philip R. Coe
*Attorney, Agent, or Firm*—Michael J. Striker

[57] ABSTRACT

Vertically reciprocatory printing elements each have an interior space for printing medium. Each element is first charged with printing medium during its reciprocation and the printing medium is then forcibly expelled from the printing element as the same reaches its printing position.

11 Claims, 4 Drawing Figures

PATTERN PRINTING APPARATUS

CROSS-REFERENCE TO RELATED APPLICATION

This application is a continuation-in-part of copending application Ser. No. 735,198, filed Oct. 26, 1976 and entitled "Method of and Apparatus for Printing Webs".

BACKGROUND OF THE INVENTION

1. Field of the Invention

This invention relates to textile printing and patterning machines.

2. The Art

In my copending application Ser. No. 735,198, the entire disclosure of which is incorporated by reference herein, I have disclosed textile printing and patterning equipment which uses dot-printing elements movable axially of themselves into and out of engagement with a workpiece web, so that in response to such engagement each element prints a color dot onto the web. The elements may be selected (by appropriate control devices) to print individually or in groups. The number and relative positions of elements selected to make up a group can be varied to obtain a desired pattern. The elements are each provided with an ink (i.e. printing medium) space from which the printing medium is derived which prints the color dots. The dots printed by adjacent ones of the elements are applied to the web so closely together that they merge, so that a continuous printed surface (rather than a rasterlike surface) is obtained.

SUMMARY OF THE INVENTION

It is an object of the present invention to provide a further improvement over the equipment disclosed in the aforementioned copending application.

More particularly, it is an object of the invention to provide an improved dot-printing apparatus of the type in question, wherein the printing medium issues from the spaces of the printing medium much more rapidly than before, so that the printing speed of the apparatus can be stepped up accordingly.

Another object is to provide such an apparatus wherein, due to the more rapid outflow of printing medium from the printing elements it is assured that each printing element supplies quantities of printing medium which are sufficient for even a high-napped (or full-napped) workpiece.

These objects are attained by communicating the printing medium spaces of the printing elements with a source of compressed gas (usually air) so that, after printing medium has entered the spaces of the printing elements, it is subsequently forcibly expelled from these spaces by the compressed gas during the printing cycle.

This greatly reduces the time required for the medium to be transferred from the space of the respective printing element to the workpiece web, and thus results in a higher printing speed. Printing media of much higher viscosity than before can be used and will be completely and rapidly expelled by the gas from their spaces in the printing elements. Moreover, the invention makes it possible to employ even printing media in form of highly viscous pastes which could not heretofore be used at all with this type of equipment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
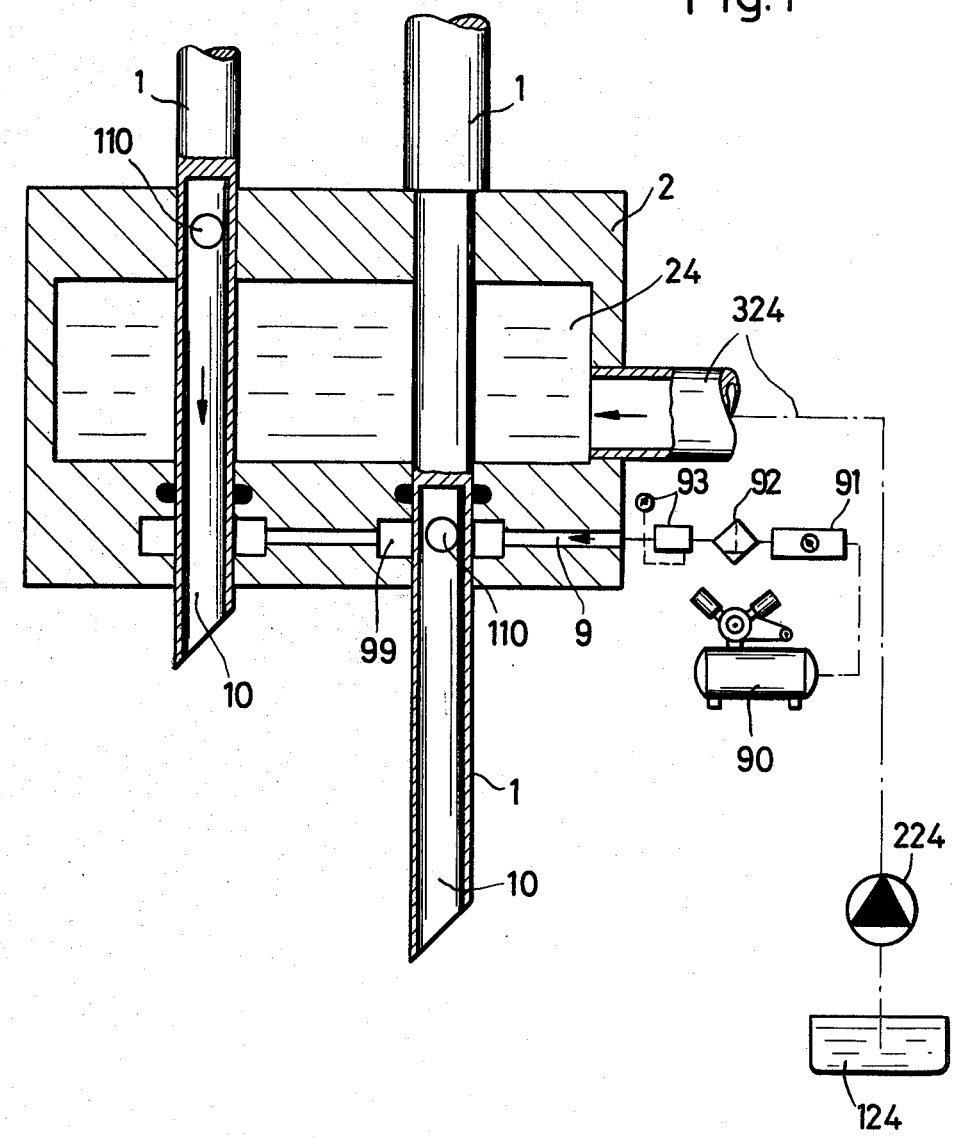
FIG. 1 is a somewhat diagrammatic view, partly in vertical section, illustrating an embodiment of the invention.

FIG. 1 shows that, in the same manner as in copending application Ser. No. 735,187, the dot-printing elements 1 are mounted for generally vertical displacement (axially of themselves) in a support beam 2 which has an interior printing medium chamber 24. Printing medium is furnished to the chamber 24 from a supply 124 by means of a variable-output pump 224 (known per se) via a conduit (rigid or flexible) 324. The chamber 24 may be pressurized to assure the quickest possible entry of printing medium (e.g. liquid, paste-like or of another consistency) into the storage space 10 in the respective printing element 1.

In the embodiment of FIG. 1 the lower portions of the elements 1 are hollow to form the spaces 10. In the upper region of these hollow portions the elements 1 each have at least one bore, cut-out or analogous port 110 which communicates with the respective space 10. In the upper position of each element 1 (see the left side in FIG. 1) the port 110 is located outside the chamber 24; when the element 1 is displaced downwardly (see the right side of FIG. 1) as indicated by the arrow, the port 110 communicates chamber 24 with space 10 so that printing medium can flow into the latter. The higher the viscosity of the printing medium, the higher must the pressure be in conduit 324 and chamber 24, to assure rapid entry of the printing medium from chamber 24 into the respective spaces 10. In the lower (printing) position the lower ends of the elements 1 contact the workpiece to be printed (see FIG. 2) and yield up their printing medium out of space 10 in form of a color dot.

In accordance with the invention this printing (i.e. yielding-up of printing medium) is facilitated and speeded up by communicating the spaces 10 with a source of compressed gas (e.g. air). The source may be a compressor 90 which supplies compressed air to a passage 9 in the beam 2, via a pressure regulator 91, a water-separator 92, and a control unit 93 with pressure-indicating gauge. The elements 91, 92 and 93 are known per se.

Passage 9 intersects the bores in which the respective elements 1 reciprocate. At each intersection the passage 9 is formed with an enlarged annular compartment 99 through which the respective element 1 must reciprocate. The arrangement is such that as the respective element reaches its lower (printing) position, its port 110 moves into communication with the compartment 99.

During movement from the upper to the lower positions of the elements 1, the spaces 10 thereof are filled with printing medium from chamber 24 in only fractions of a second. As soon as thereafter the respective port 110 moves into communication with the associated compartment 99, the compressed air (or gas) in passage 9 blasts the contents of the space 10 through the lower open end of the element 1 and onto the workpiece web 3 (FIG. 2) which rests on a printing blanket 4 (or the like) that is engaged from beneath by a support beam 400 or the like. The spaces 10 are completely emptied out in fractions of a second, even if the printing medium is extremely viscous. The cooperation of ports 110 with the compartments 99 in the illustrated and described manner represents a very simple solution to the timing of the compressed-gas flow and eliminates the need for complicated valving and/or timing devices and for movable hoses or the like which can break or become snagged.

Figure 2:
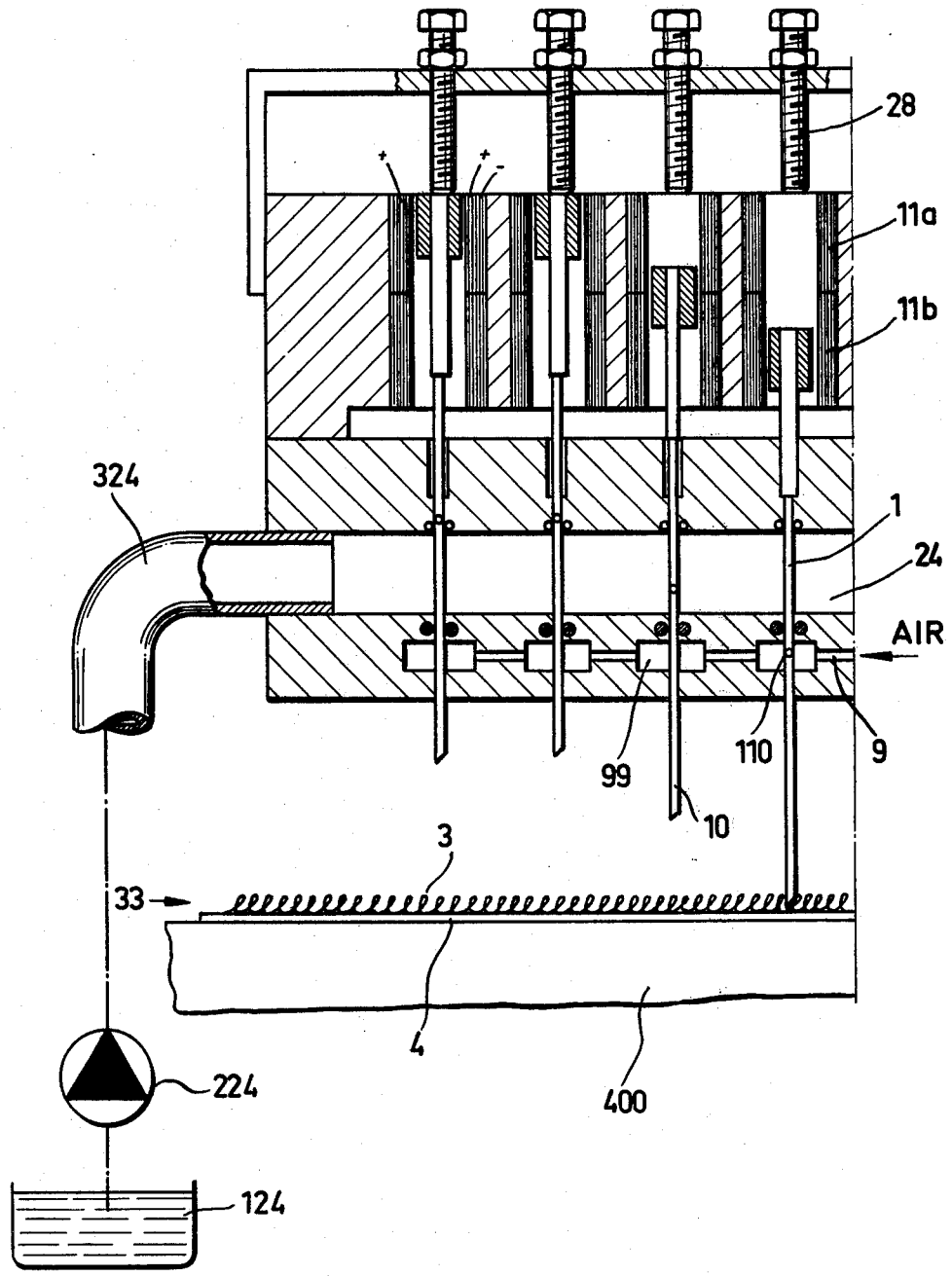
FIG. 2 is a view analogous to that of FIG. 1 but showing another embodiment.

The embodiment in FIG. 2 is substantially the same as the one in FIG. 1 and uses like reference numerals for like elements. It differs from FIG. 1 only in that the reciprocation of the printing elements 1 is shown to be effected (powered) by electromagnets 11*a*, 11*b*. Limit screws 28 allow the extent of upward displacement of the elements 1 to be selected by an operator.

Figure 4:
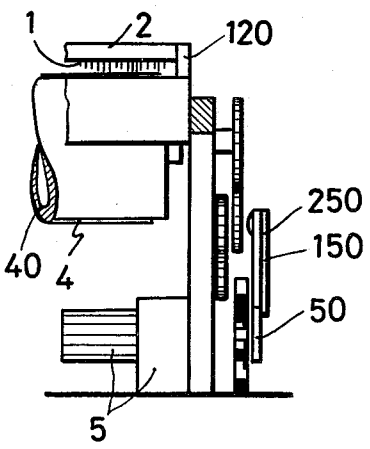
FIG. 4 is a fragmentary transverse view, showing a detail of the apparatus in FIG. 3 and taken on line IV—IV of FIG. 3.
Figure 3:
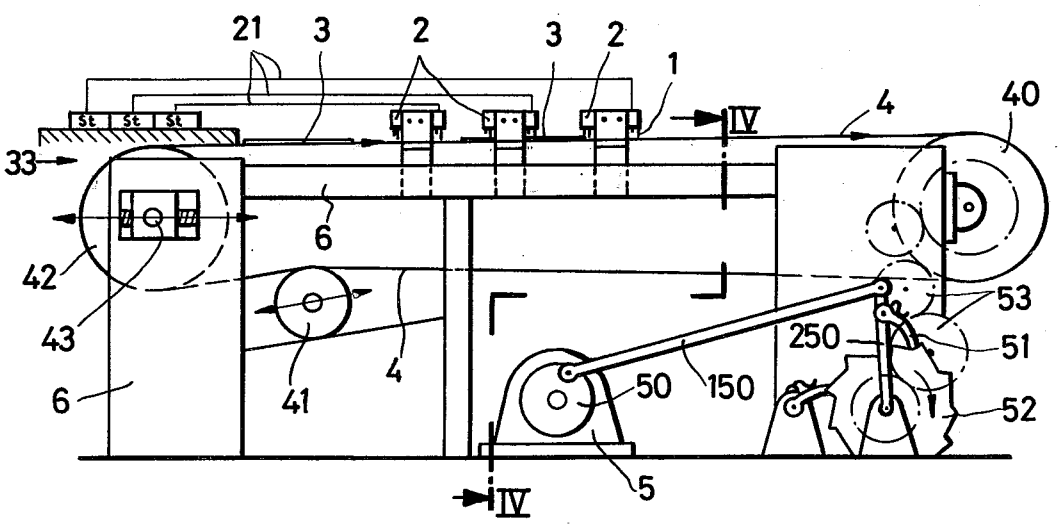
FIG. 3 is a diagrammatic side view of an apparatus embodying the invention.

An exemplary machine embodying the invention is shown in FIGS. 3 and 4. It has three of the beams 2 which are mounted upwardly of the working plane 33 in which the workpiece web 3 (e.g. a carpet or other textile or non-textile material) is transported in the direction of the arrows by the travelling printing blanket 4. The web 3 may be continuous or in form of individual sheets. It may be, as already indicated, a textile material or a non-textile material; for example, it may be fibrous sliver, blotting paper, foil material, or the like.

The endless printing blanket 4 is advanced (towards the right in FIG. 3) by a drive roller 40 about which it is trained. In addition, printing blanket 4 is also trained about a tension-regulating roller 41 and an upstream reversing roller 42 which is provided with a blanket-tensioning arrangement 43 (known per se). A frame 6 supports all of these components.

A main machine drive 5 drives the blanket 4 stepwise or continuously, dependent upon what type of pattern is to be printed. FIGS. 3 and 4 illustrate an intermittent (stepwise) drive, for which purpose the main machine drive 5 rotates a crank disk 50 which transmits motion via cranks 150 and 250 to a ratchet wheel 52. The latter is constrained to stepwise movement by a pawl 51 which is mounted on crank 250 and engages the teeth of wheel 52 to advance the same by one step (one tooth) each time the cranks 150, 250 perform an operating cycle. A gear train 53 transmits this motion to the roller 40 which entrains the printing blanket 4. The steps (i.e. the increments advancement of printing blanket 4) may be made adjustable so that they can be selected to be as small as 0.5 mm each or as large as desired.

Each beam 2 is mounted on lateral supports 120 which in turn are secured on uprights of the machine. This is shown in FIG. 4 for one beam and for one side of the machine. Control lines (e.g. electrical conductors) 21 connect the beams 2 and their devices which reciprocate the members 1 (e.g. magnets 11*a*, 11*b*) with control units, e.g. computers, punch-card controls, magnetic-tape controls. These devices then select which of the elements 1 are to print and at what times. Such devices are already known for the pattern control in Jaquard machines; they can be analogously used in the present apparatus and permit ever new patterns to be selected and created.

It should be understood that the term "printing medium" as used herein includes not only coloring matter (e.g. ink), but any substance that can be "printed" onto a workpiece web by means of the disclosed medium, including — but not limited to — adhesive and the like.

While the invention has been illustrated and described as embodied in a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a pattern printing apparatus, a combination comprising a plurality of reciprocatory printing elements each having a printing-medium space and a leading end provided with an outlet from said space; means for reciprocating each of said elements between an advanced printing position in which said outlet is located at a workpiece to be printed, and a retracted position; means for charging printing medium into the respective space during movement of said elements between said positions; and means for forcibly expelling the printing medium from the respective space when said elements are in said printing position.

2. A combination as defined in claim 1, wherein said expelling means comprises means for communicating the respective spaces with a source of gas under pressure.

3. A combination as defined in claim 2, said source including a pressurized-gas conduit.

4. A combination as defined in claim 2, each of said elements having a port which opens into said space of the element and communicates sequentially with said charging means and with said source during movement of each of said elements from and to said printing position.

5. A combination as defined in claim 4, said charging means comprising wall means bounding a printing-medium chamber and provided with a plurality of bores each accommodating one of said elements for reciprocation, said communicating means comprising a pressurized-gas passage forming an intersection with each of said bores and communicating with the respective spaces when the port of a respective element passes into the associated intersection.

6. A combination as defined in claim 5, wherein said pressurized-gas passage is provided at each intersection with an annularly enlarged passage portion surrounding and communicating with the intersection.

7. A combination as defined in claim 1, said charging means comprising a printing-medium chamber, and means for admitting printing medium under pressure into said chamber.

8. A combination as defined in claim 7, said means for admitting comprising a variable-output pump adapted to receive printing medium from a source, and conduit means connecting said pump with said chamber.

9. A combination as defined in claim 1; further comprising means for connecting said elements with an arrangement for controlling the reciprocation of said elements.

10. A combination as defined in claim 1; and further comprising workpiece supporting means having a workpiece supporting surface downwardly spaced from the position assumed by said outlet when the respective element is in said printing position thereof.

11. A combination as defined in claim 1; and further comprising workpiece supporting means having a workpiece supporting surface located in a plane which is at least closely adjacent to the position assumed by said outlet when the respective element is in said printing position thereof.

* * * * *